US006659090B2

(12) United States Patent
Sisken

(10) Patent No.: US 6,659,090 B2
(45) Date of Patent: Dec. 9, 2003

(54) SYSTEM FOR PURGING EXHAUST GASES FROM EXHAUST GAS RECIRCULATION SYSTEM

(75) Inventor: Kevin D. Sisken, Saline, MI (US)

(73) Assignee: Detroit Diesel Corporation, Detroit, MI (US)

( * ) Notice: Subject to any disclaimer, the term of this patent is extended or adjusted under 35 U.S.C. 154(b) by 183 days.

(21) Appl. No.: 10/043,412

(22) Filed: Jan. 10, 2002

(65) Prior Publication Data

US 2003/0127077 A1 Jul. 10, 2003

(51) Int. Cl.[7] ..... F02M 25/07
(52) U.S. Cl. ..... 123/568.11; 123/568.21
(58) Field of Search ..... 123/568.11, 568.12, 123/568.21; 60/605.2

(56) References Cited

U.S. PATENT DOCUMENTS

| | | | | |
|---|---|---|---|---|
| 4,360,317 A | | 11/1982 | Vallance et al. | |
| 4,467,774 A | | 8/1984 | Becker et al. | |
| 5,714,683 A | | 2/1998 | Maloney | |
| 5,724,952 A | | 3/1998 | Miyashita et al. | |
| 5,753,805 A | | 5/1998 | Maloney | |
| 5,937,834 A | * | 8/1999 | Oto | 123/568.18 |
| 6,176,227 B1 | | 1/2001 | Ohuchi et al. | |
| 6,205,785 B1 | * | 3/2001 | Coleman | 60/605.2 |
| 6,257,213 B1 | | 7/2001 | Maeda | |

FOREIGN PATENT DOCUMENTS

| | | |
|---|---|---|
| EP | 0 840 000 A1 | 5/1998 |
| JP | 11093781 A | 4/1999 |
| JP | 11324821 A | 11/1999 |

* cited by examiner

*Primary Examiner*—Mahmoud Gimie
(74) *Attorney, Agent, or Firm*—Brooks Kushman P.C.

(57) ABSTRACT

A system for providing exhaust gas recirculation in a multi-cylinder compression ignition internal combustion engine include an EGR valve in communication with an exhaust side of the engine to selectively direct exhaust gases to the EGR system. Charge air is directed through the engine and/or EGR system to purge exhaust gases from the EGR system. Charge air may be supplied to the EGR system by maintaining the intake manifold pressure above the pressure in the exhaust manifold.

10 Claims, 2 Drawing Sheets

SYSTEM FOR PURGING EXHAUST GASES FROM EXHAUST GAS RECIRCULATION SYSTEM

BACKGROUND OF THE INVENTION

1. Field of the Invention

The present invention relates to a system for purging exhaust gases from an exhaust gas recirculation (EGR) system for a compression-ignition internal combustion engine to minimize corrosion of EGR components caused by condensation of residual gases in the EGR system.

2. Background Art

Compression-ignition internal combustion engines may be equipped with EGR systems to reduce NOX emissions. EGR systems include an EGR circuit in which tubing interconnects an EGR cooler, EGR flowmeter, and EGR valve.

When an engine is operating, hot exhaust gases may be circulated through the EGR system. When the engine is shut down, the components of the EGR system cool causing condensation. The gases that condense in the EGR system after engine shut down are acidic and can cause corrosion of the components of the EGR circuit. As the exhaust gases cool in the EGR circuit, condensation forms on the interior surfaces of the components of the EGR circuit.

EGR systems for diesel engines equipped with a turbocharger that pressurizes intake air require a system for increasing pressure in the EGR system above the pressure of the intake. For example, with a variable geometry turbocharger, the vanes of the turbine can be partially closed to create back pressure to allow flow in the EGR system.

There is a need for a method and apparatus for purging gases from the EGR circuit when the engine is shut down to avoid or minimize condensation of the acidic EGR gases in the EGR circuit. There is also a need to purge EGR gases by flushing with fresh intake air to reduce the acidity of any condensate and prolong the life of the EGR circuit components by minimizing corrosion.

The above problems and needs are addressed by Applicant's invention as summarized below.

SUMMARY OF THE INVENTION

According to one aspect of the present invention, a system for providing exhaust gas recirculation in a multi-cylinder compression-ignition internal combustion engine having an intake side and an exhaust side is provided wherein intake air is ported through the EGR system prior to engine shut down. The system includes an EGR valve in communication with the exhaust side of the engine that selectively diverts a portion of exhaust gases from the internal combustion engine through an EGR circuit to the intake side of the engine. The EGR control can be used to provide higher intake manifold pressure than the exhaust manifold pressure prior to or as part of engine shut down. By creating higher pressure on the intake side while the EGR valve is held open, exhaust gases can be flushed from the EGR circuit. If a variable geometry turbocharger is provided as part of the engine, the turbine vanes may be adjusted to reduce pressure in the EGR circuit and thereby allow the intake manifold pressure to be higher than the exhaust manifold pressure.

According to another aspect of the invention, the EGR valve may be held open by an engine control module for a predetermined period of time after the engine reaches idle condition. The EGR valve may be held open for a predetermined period of time that is at least equal to the period of time required to fill the EGR system three times with air.

According to another aspect of the invention, a method of purging exhaust gases from an EGR system of a multi-cylinder compression-ignition internal combustion engine is provided. The method includes the step during engine shut down of setting the intake manifold pressure higher than the exhaust manifold pressure. The EGR valve is held open for a predetermined period of time so that air may be directed from the intake manifold to the EGR system and into the exhaust manifold.

According to another aspect of the invention, a method is provided for purging exhaust gases from an EGR system of a multi-cylinder compression internal combustion engine that powers a generator set. The engine has an intake side and an exhaust side that runs at light loads for a period of time before shut down while the engine is operating at light loads. The method includes setting the intake manifold pressure higher than the exhaust manifold pressure, opening the EGR valve for a predetermined period of time and directing air from the intake manifold to the exhaust manifold into the EGR system.

According to other aspects of the invention, the method of purging exhaust gases from the EGR system can be utilized on an engine flowing EGR at idle. When power to an ignition circuit is turned off, the method may also be carried out with an engine having a variable geometry turbocharger that may be set to hold the intake manifold pressure higher than the exhaust manifold pressure while the EGR valve is held open at engine shut down.

According to another aspect of the invention, if the intake manifold pressure is not maintained at a higher pressure than the exhaust manifold pressure, then the EGR valve may still be held open during engine spin down to allow exhaust gases (no combustion during engine spin down) to continue to enter the EGR system thereby allowing cleaner air to flush the EGR circuit.

The above advantages, and other advantages, objects, and features of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
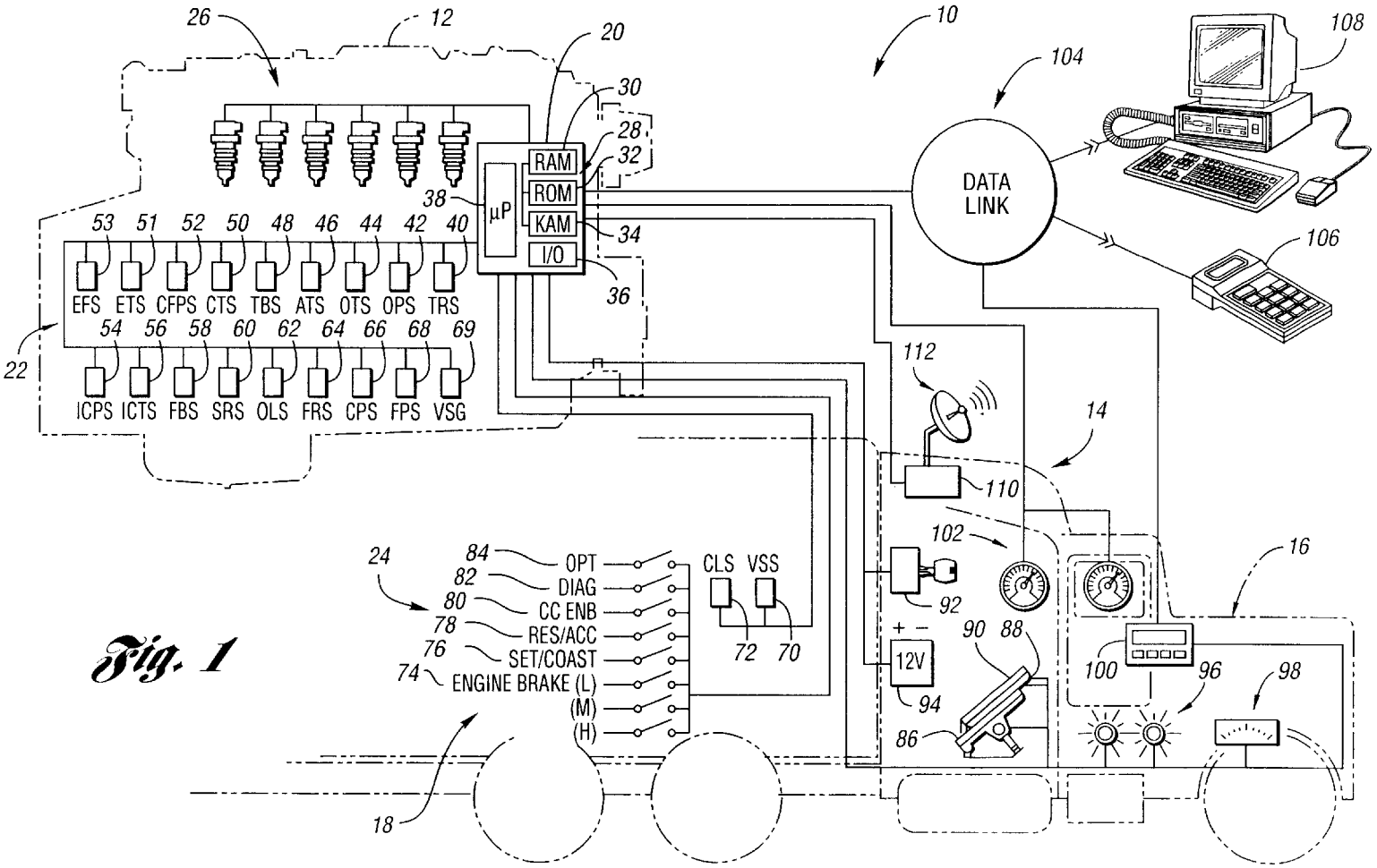
FIG. 1 is a block diagram illustrating one application of a system or method for providing EGR in a multi-cylinder compression ignition engine according to one embodiment of the present invention.

FIG. 1 provides a schematic/block diagram illustrating operation of a system or method for providing EGR in a representative application according to one embodiment of the present invention. The system 10 includes a multi-cylinder compression ignition internal combustion engine, such as a diesel engine 12, which may be installed in a vehicle 14 depending upon the particular application. In one embodiment, vehicle 14 includes a tractor 16 and semi-trailer 18. Diesel engine 12 is installed in tractor 16 and interfaces with various sensors and actuators located on engine 12, tractor 16, and semi-trailer 18 via engine and vehicle wiring harnesses as described in further detail below. In other applications, engine 12 may be used to operate industrial and construction equipment, or in stationary applications for driving generators, compressors, and/or pumps and the like.

An electronic engine control module (ECM) 20 receives signals generated by engine sensors 22 and vehicle sensors 24 and processes the signals to control engine and/or vehicle actuators such as fuel injectors 26. ECM 20 preferably includes computer-readable storage media, indicated generally by reference numeral 28 for storing data representing instructions executable by a computer to control engine 12. Computer-readable storage media 28 may also include calibration information in addition to working variables, parameters, and the like. In one embodiment, computer-readable storage media 28 include a random access memory (RAM) 30 in addition to various non-volatile memory such as read-only memory (ROM) 32, and keep-alive or non-volatile memory (KAM) 34. Computer-readable storage media 28 communicate with a microprocessor 38 and input/output (I/O) circuitry 36 via a standard control/address bus. As will be appreciated by one of ordinary skill in the art, computer-readable storage media 28 may include various types of physical devices for temporary and/or persistent storage of data which includes solid state, magnetic, optical, and combination devices. For example, computer readable storage media 28 may be implemented using one or more physical devices such as DRAM, PROMS, EPROMS, EEPROMS, flash memory, and the like. Depending upon the particular application, computer-readable storage media 28 may also include floppy disks, CD ROM, and the like.

In a typical application, ECM 20 processes inputs from engine sensors 22, and vehicle sensors/switches 24 by executing instructions stored in computer-readable storage media 28 to generate appropriate output signals for control of engine 12. In one embodiment of the present invention, engine sensors 22 include a timing reference sensor (TRS) 40 which provides an indication of the crankshaft position and may be used to determine engine speed. An oil pressure sensor (OPS) 42 and oil temperature sensor (OTS) 44 are used to monitor the pressure and temperature of the engine oil, respectively.

An air temperature sensor (ATS) 46 is used to provide an indication of the current intake air temperature. A turbo boost sensor (TBS) 48 is used to provide an indication of the boost pressure of a turbocharger which is preferably a variable geometry or variable nozzle turbocharger as described in greater detail below. Coolant temperature sensor (CTS) 50 is used to provide an indication of the coolant temperature. Depending upon the particular engine configuration and application, various additional sensors may be included. For example, engines which utilize exhaust gas recirculation (EGR) according to the present invention preferably include an EGR temperature sensor (ETS) 51 and an EGR flow sensor (EFS) 53. EFS 53 is preferably a hot wire anemometer type sensor which detects a differential temperature of two heated elements to determine the mass flow rate of EGR through the EGR circuit. The heated elements preferably provide pyrolitic cleaning by being heated to a temperature to reduce or prevent soot accumulation. Alternatively, a $\Delta P$ sensor may be used to determine the EGR flow rate as described in U.S. application Ser. No. 09/641,256 filed Aug. 16, 2000 and assigned to the assignee of the present invention, the disclosure of which is hereby incorporated by reference in its entirety.

Applications utilizing a common rail fuel system may include a corresponding fuel pressure sensor (CFPS) 52. Similarly, an intercooler coolant pressure sensor (ICPS) 54 and temperature sensor (ICTS) 56 may be provided to sense the pressure and temperature of the intercooler coolant. Engine 12 also preferably includes a fuel temperature sensor (FTS) 58 and a synchronous reference sensor (SRS) 60. SRS 60 provides an indication of a specific cylinder in the firing order for engine 12. This sensor may be used to coordinate or synchronize control of a multiple-engine configuration such as used in some stationary generator applications. An EGR cooler and corresponding temperature sensor may also be provided to cool recirculated exhaust gas prior to introduction to the engine intake.

Engine 12 may also include an oil level sensor (OLS) 62 to provide various engine protection features related to a low oil level. A fuel restriction sensor (FRS) 64 may be used to monitor a fuel filter and provide a warning for preventative maintenance purposes. A fuel pressure sensor (FPS) 68 provides an indication of fuel pressure to warn of impending power loss and engine fueling. Similarly, a crankcase pressure sensor (CPS) 66 provides an indication of crankcase pressure which may be used for various engine protection features by detecting a sudden increase in crankcase pressure indicative of an engine malfunction.

System 10 preferably includes various vehicle sensors/switches 24 to monitor vehicle operating parameters and driver input used in controlling vehicle 14 and engine 12. For example, vehicle sensors/switches 24 may include a vehicle speed sensor (VSS) which provides an indication of the current vehicle speed. A coolant level sensor (CLS) 72 monitors the level of engine coolant in a vehicle radiator. Switches used to select an engine operating mode or otherwise control operation of engine 12 or vehicle 14 may include an engine braking selection switch 74 which preferably provides for low, medium, high, and off selections, cruise control switches 76, 78, and 80, a diagnostic switch 82, and various optional, digital, and/or analog switches 84. ECM 20 also receives signals associated with an accelerator or foot pedal 86, a clutch 88, and a brake 90. ECM 20 may also monitor position of a key switch 92 and a system voltage provided by a vehicle battery 94.

ECM 20 may communicate with various vehicle output devices such as status indicators/lights 96, analog displays 98, digital displays 100, and various analog/digital gauges 102. In one embodiment of the present invention, ECM 20 utilizes an industry standard data link 104 to broadcast various status and/or control messages which may include engine speed, accelerator pedal position, vehicle speed, and the like. Preferably, data link 104 conforms to SAE J1939 and SAE J1587 to provide various service, diagnostic, and control information to other engine systems, subsystems, and connected devices such as display 100. Preferably, ECM 20 includes control logic to determine EGR flow and temperature and to selectively divert at least a portion of the EGR flow around the EGR cooler to reduce or eliminate condensation of the recirculated exhaust gas.

A service tool 106 may be periodically connected via data link 104 to program selected parameters stored in ECM 20 and/or receive diagnostic information from ECM 20. Likewise, a computer 108 may be connected with the appropriate software and hardware via data link 104 to transfer information to ECM 20 and receive various information relative to operation of engine 12, and/or vehicle 14.

Figure 2:
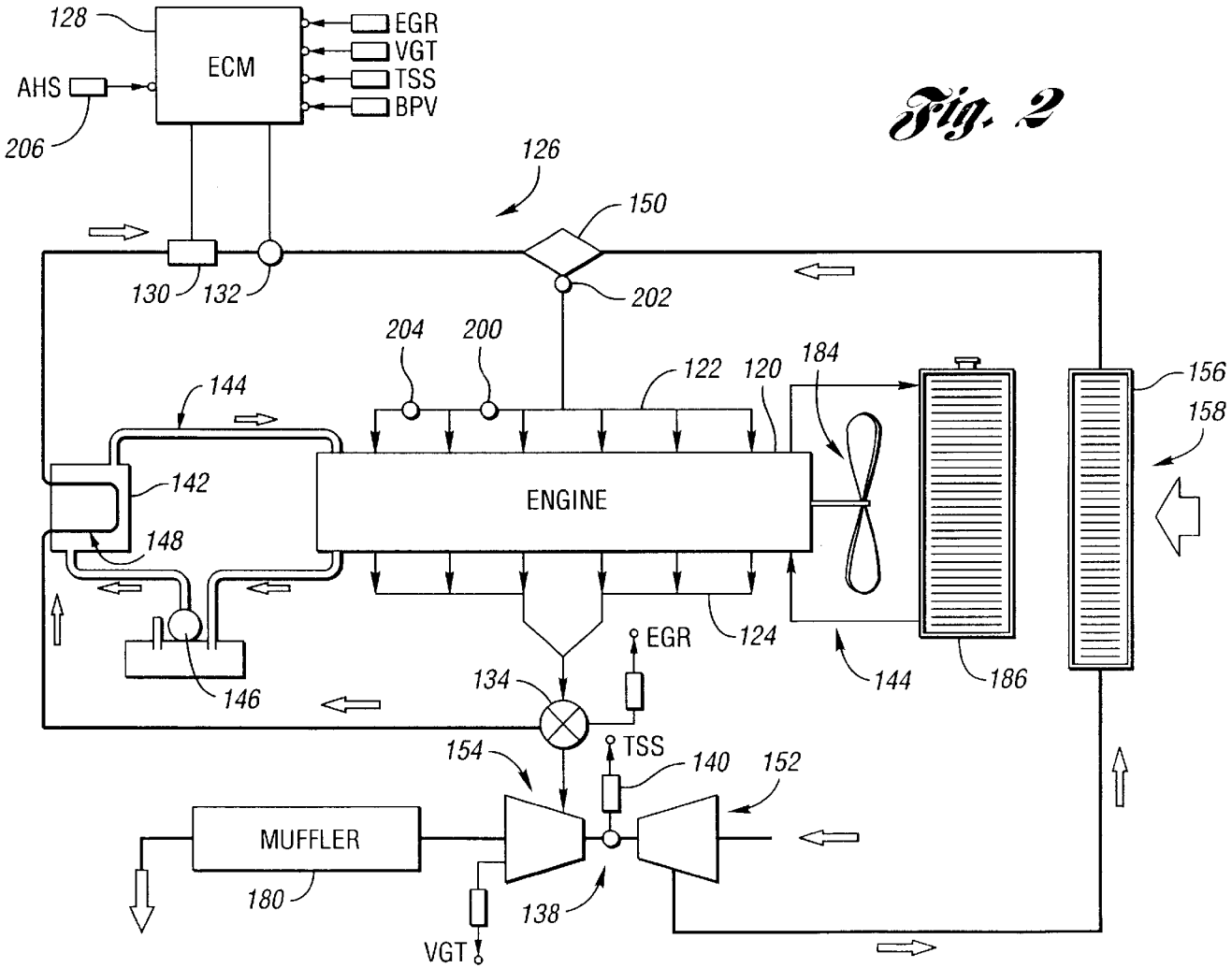
FIG. 2 is a block diagram illustrating a representative EGR circuit for a compression ignition engine according to one embodiment of the present invention.

FIG. 2 is a block diagram illustrating a representative EGR system. Engine 120 includes an intake manifold 122, an exhaust manifold 124, and an exhaust gas recirculation (EGR) system indicated generally by reference numeral 126.

An engine control module (ECM) 128 includes stored data representing instructions and calibration information for controlling engine 120. ECM 128 communicates with various sensors and actuators including EGR sensors such as EGR flow sensor 130 and EGR temperature sensor 132. As described above, EGR flow sensor 130 is preferably an anemometer-type sensor. ECM 128 controls EGR system 126 via actuators such as an EGR valve 134. In addition, ECM 128 preferably controls a variable nozzle or variable geometry turbocharger (VGT) 138 may monitor an associated turbo speed sensor 140 and turbo boost sensor 48 as described with reference to FIG. 1.

EGR system 126 preferably includes an EGR cooler 142 which is connected to the engine coolant circuit indicated generally by reference numeral 144. EGR cooler 142 is preferably a full-flow cooler connected in-line with the engine coolant system. EGR cooler 142 may be directly coupled to a corresponding water or coolant pump 146, or may be placed at a different location in the engine cooling circuit depending upon the particular application.

In operation, ECM 128 controls EGR system 126 and VGT 138 based on current operating conditions and calibration information to mix recirculated exhaust gas with charge air via mixer 150 which is preferably a pipe union. The combined charge air and recirculated exhaust gas is then provided to engine 120 through intake manifold 122. In the illustrated embodiment, engine 120 is a 6-cylinder compression-ignition internal combustion engine. ECM 128 includes control logic to monitor current engine control parameters and operating conditions to control EGR system 126. During operation of engine 120, intake air passes through compressor portion 152 of VGT 138 which is powered by turbine portion 154 via hot exhaust gasses. Compressed air travels through charge air cooler 156 which is preferably an air-to-air cooler cooled by ram air 158. Charge air passes through cooler 156 to mixer 150 where it is combined with recirculated exhaust gas.

The exhaust gas recirculation system 126 of the engine 120 receives exhaust gases from the exhaust manifold 124 of the engine 120 through the EGR valve 134. A portion of the exhaust gases are directed to the variable geometry turbocharger 138 and another portion of the exhaust gases are ported through the EGR cooler 142. To pressurize the EGR, the vanes of the turbine 154 may be partially closed during normal engine operation. Exhaust gases are then directed through an EGR flow sensor 130 and EGR temperature sensor 132. The exhaust gases then are directed to a mixer 150 that mixes the exhaust gas with charge air. The mixture of exhaust gas and charge air is directed to the intake manifold 122 of the engine 120.

The EGR system 126 may be flushed with fresh air by maintaining the intake manifold 122 pressure higher than the exhaust manifold 124 pressure so that charge air received from the charge air cooler 156 flushes the EGR system 126. The variable geometry turbocharger 138 may be used to maintain the intake manifold pressure at a higher level than the exhaust manifold pressure.

According to another approach, the EGR valve 134 may be held open by the engine control module 128 for a predetermined period of time after the engine begins its shut down procedure. Holding the EGR valve 134 open while the engine shuts down allows air to flow from the charge air cooler 158 and continues to fill the engine 120 as combustion is terminated. Preferably, a predetermined period of time is provided such that the EGR system may be filled at least three times with air. During engine spin down the EGR valve 134 could be held open even if the exhaust manifold 124 pressure is greater than the intake manifold 122 pressure since the fuel is turned off and the exhaust air does not contain combustion gases. This clean exhaust air can be used to purge the EGR system 126.

According to the method of the present invention, exhaust gases may be purged from the EGR system 126 of the engine 120. The engine 120 has an intake side 122 and an exhaust side 124. The engine 120 normally is run at idle for a period of time before shut down. As the engine 120 runs at idle prior to shut down, the intake manifold pressure is set higher than the exhaust manifold pressure. The next step is to open the EGR valve 134 for a predetermined period of time. Air is directed from the intake manifold 122 to the EGR system 126 and into the exhaust manifold 124 to flush the EGR system 126 with intake or charge air. Air is directed from the intake manifold 122 through the EGR system 126 for a period of time sufficient to allow the EGR system to be flushed.

According to another aspect of the invention, exhaust gases are purged from an EGR system 126 and an engine 120 that powers the generator set. As described above, the engine has an intake side and an exhaust side and in the generator set application the engine runs at light loads for a period of time before shut down. As the engine runs at light load, the intake manifold 122 pressure is set higher than the exhaust manifold 124 pressure. The EGR valve is held open for a period of time so that air may be directed from the intake manifold 122 to the EGR system 126 and into the exhaust manifold 124. If the engine flows EGR at idle, power to an ignition circuit may be turned off and the variable geometry turbocharger 138 may be set to hold the intake manifold pressure higher than the exhaust manifold pressure while the EGR valve 134 is held open. If the intake manifold pressure can not be maintained higher than the exhaust manifold pressure, then the EGR valve 134 may be held closed during engine spin down to prevent exhaust gases from continuing to enter the EGR system 126.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for providing exhaust gas recirculation (EGR) in a multi-cylinder compression ignition internal combustion engine having an intake side and an exhaust side, the system comprising:

an EGR valve in communication with the exhaust side of the engine to selectively divert a portion of exhaust from the internal combustion engine through an EGR circuit to the intake side of the engine;

a charge air cooler for supplying cool air to the intake side;

an engine control module that controls the pressure on the intake side relative to the exhaust side during engine operation and shut down to selectively direct air through the EGR system to purge exhaust gases from the EGR circuit upon engine shut down.

2. The system of claim 1 wherein a variable geometry turbo charger is controlled by the engine control module to maintain the intake manifold pressure at a level higher than the exhaust manifold pressure.

3. The system of claim 1 wherein the EGR valve is held open by an engine control module for a predetermined period of time after the engine begins its shutdown procedure.

4. The system of claim 3 wherein the predetermined period of time is at least equal to the period of time required to fill the EGR system at least three times with air.

5. The system of claim 1 wherein the EGR circuit includes an EGR cooler, an EGR flow meter, the EGR valve, and EGR tubing.

6. A method of purging exhaust gases from an EGR system of a multi-cylinder compression ignition internal combustion engine having an intake side and an exhaust side that runs at idle for a period of time before shut down, comprising:

setting the intake manifold pressure higher than the exhaust manifold pressure;

holding the EGR valve open for a predetermined period of time after engine shut down; and directing air from the intake manifold into the EGR system.

7. The method of claim 6 wherein the predetermined period of time is at least equal to the period of time required to fill the EGR system three times with air.

8. The method of purging exhaust gases from an EGR system of claim 6 wherein the engine flows EGR at idle and wherein the power to an ignition circuit is turned off, a variable geometry turbocharger being set to hold the intake manifold pressure higher than exhaust manifold pressure and the EGR valve being held open.

9. A method of purging exhaust gases from an EGR system of a multi-cylinder compression ignition internal combustion engine that powers a generator set, the engine having an intake side and an exhaust side that runs at light loads for a period of time before shut down while the engine is operating at light loads, comprising:

setting the intake manifold pressure less than or equal to the exhaust manifold pressure; and holding the EGR valve closed during an engine spin down period to prevent exhaust gases from continuing to enter the EGR system.

10. A method of purging exhaust gases from an EGR system of a multi-cylinder compression ignition internal combustion engine having a fuel system for supplying fuel to the engine, comprising:

shutting off the fuel system to stop supplying fuel to the engine and causing the engine to spin down; and holding the EGR valve open during engine spin down thereby purging gases from the EGR system.

* * * * *